US009515386B2

(12) United States Patent
Asplund et al.

(10) Patent No.: US 9,515,386 B2
(45) **Date of Patent: *Dec. 6, 2016**

(54) ANTENNA ARRANGEMENT

(71) Applicant: Telefonaktiebolaget L M Ericsson (PUBL), Stockholm (SE)

(72) Inventors: Henrik Asplund, Stockholm (SE); Anders Derneryd, Gothenburg (SE); Jonas Medbo, Uppsala (SE)

(73) Assignee: TELEFONAKTIEBOLAGET LM ERICSSON (PUBL), Stockholm (SE)

( * ) Notice: Subject to any disclaimer, the term of this patent is extended or adjusted under 35 U.S.C. 154(b) by 0 days.

This patent is subject to a terminal disclaimer.

(21) Appl. No.: 15/003,553

(22) Filed: Jan. 21, 2016

(65) Prior Publication Data

US 2016/0141763 A1 May 19, 2016

Related U.S. Application Data

(63) Continuation of application No. 13/990,375, filed as application No. PCT/EP2010/068445 on Nov. 29, 2010, now Pat. No. 9,246,229.

(51) Int. Cl.
*H01Q 13/10* (2006.01)
*H01Q 13/20* (2006.01)
(Continued)

(52) U.S. Cl.
CPC ..... *H01Q 13/203* (2013.01); *H01Q 1/007* (2013.01); *H01Q 1/521* (2013.01); *H01Q 13/22* (2013.01); *H01Q 21/205* (2013.01); *H01Q 21/28* (2013.01)

(58) Field of Classification Search
CPC .... H01Q 1/007; H01Q 13/203; H01Q 21/205; H01Q 1/521; H01Q 13/22; H01Q 21/28
(Continued)

(56) References Cited

U.S. PATENT DOCUMENTS 9,246,229 B2 * 1/2016 Asplund ..... H01Q 1/007
2007/0207316 A1 9/2007 Aisenbrey
(Continued)

FOREIGN PATENT DOCUMENTS

CN 101404350 A 4/2009
JP 63290416 A 11/1988
(Continued)

OTHER PUBLICATIONS

Tago et al. "Design and Characteristics of Radiating Pair Cable" Proceedings of International Wire and Cable Symposium, Nov. 1, 1983, vol. 32nd, pp. 30-36.
(Continued)

*Primary Examiner* — Hoanganh Le
(74) *Attorney, Agent, or Firm* — Rothwell, Figg, Ernst & Manbeck, P.C.

(57) ABSTRACT

An antenna arrangement comprising at least a first and a second elongated structure, e.g., a coaxial cable, for guiding an electromagnetic wave is provided. Each of said structures comprises a plurality of radiation elements. The structures are positioned alongside each other in their longitudinal direction of extension forming a bundle. The elongated structures are arranged within the bundle such that the radial positions of said structures are alternated in the longitudinal direction of extension.

13 Claims, 7 Drawing Sheets

(51) Int. Cl.

| | |
|---|---|
| ***H01Q 1/00*** | (2006.01) |
| ***H01Q 1/52*** | (2006.01) |
| ***H01Q 13/22*** | (2006.01) |
| ***H01Q 21/20*** | (2006.01) |
| ***H01Q 21/28*** | (2006.01) |

(58) Field of Classification Search
USPC ..... 343/770, 771, 767
See application file for complete search history.

(56) References Cited

U.S. PATENT DOCUMENTS

| | | | |
|---|---|---|---|
| 2011/0234338 | A1 | 9/2011 | Takahashi |
| 2013/0088407 | A1 | 4/2013 | King et al. |
| 2013/0098674 | A1 | 4/2013 | Shoemaker et al. |

FOREIGN PATENT DOCUMENTS

| | | | |
|---|---|---|---|
| JP | 2005 190896 | A | 7/2005 |
| JP | 2005 286812 | A | 10/2005 |

OTHER PUBLICATIONS

International Search Report and the Written Opinion of the International Searching Authority dated Sep. 22, 2011, in International Application No. PCT/EP2010/068445, 11 pages.
Office Action dated Jul. 2, 2014, issued in Chinese Patent Application No. 201080070405.2, 7 pages.

* cited by examiner

ANTENNA ARRANGEMENT

TECHNICAL FIELD

The present invention discloses a novel antenna arrangement.

BACKGROUND

When deploying wireless communications systems such as, for example, cellular systems, in indoor environments in general, traditional kinds of antennas can be less suitable to use. In such environments, use is sometimes instead made of so called "leaky cables", also sometimes referred to as leaky feeders or radiating cables.

A leaky cable is a cable which is capable of conducting electromagnetic radio frequency energy, and which has been provided with apertures in order to make the cable radiate, i.e. to allow some of the energy to "leak" from the cable, thus enabling the cable act as an antenna. Such an antenna, i.e. a leaky cable, will due to reciprocity be able to act equally well as a receiving as a transmitting antenna. Due to its nature of a cable, a "leaky cable antenna" will, as compared to a traditional antenna, act more like a line source than a point source, thus making it easier to obtain coverage in tunnels, along railways or where a high degree of "shadowing" occurs when using a point source antenna. An example of the latter is an indoor scenario, e.g. an office landscape.

In recent years demands for high user bitrates and capacity have increased dramatically due to the growth of mobile broadband usage. In order to achieve higher user bitrates and spectrum efficiency multiple antenna techniques like Multiple Input Multiple Output (MIMO) are employed in wireless communications systems.

In deployments where multiple leaky feeders are used it is a great benefit, regarding installation, to bundle them. However, the individual characteristics of the cables may differ substantially regarding directivity. If more than two cables are bundled there might also be significant radiation efficiency differences due to mutual coupling. Azimuth antenna patterns for two cables which are bundled and extended along an axis perpendicular to the figure are shown in FIG. 1. As can be seen in the figure, a problem is that the antenna patterns only partly cover the same angular interval. A consequence is power imbalance for the different antenna branches of the leaky cables which is particularly prominent in line-of-sight conditions. The power imbalance is a problem in e.g. MIMO multi stream transmissions causing reduced capacity.

SUMMARY

It is therefore an object of the present invention to address some of the problems and disadvantages outlined above and to provide an antenna arrangement with leaky cables which has improved properties as compared to the prior art.

The above stated object is achieved by means of an antenna arrangement according to the independent claims, and by the embodiments according to the dependent claims.

According to an embodiment of the present invention an antenna arrangement comprising at least a first and a second elongated structure for guiding an electromagnetic wave is provided. Each one of the structures comprises a plurality of radiation elements and each structure exhibits a longitudinal direction of extension. Moreover, the structures are positioned alongside each other in their longitudinal direction of extension forming a bundle. Additionally, the structures are arranged within the bundle such that the radial positions of said structures are alternated in the longitudinal direction of extension.

An advantage of embodiments of the present invention is that they provide an antenna arrangement suitable for MIMO multi stream transmissions.

Yet another advantage of embodiments is that they even out the radiation performance and improve the link gains along the extension of elongated structures comprising the plurality of radiation elements.

Further advantages and features of embodiments of the present invention will become apparent when reading the following detailed description in conjunction with the drawings.

BRIEF DESCRIPTION OF THE DRAWINGS

For a better understanding, reference is made to the following drawings and preferred embodiments of the invention.

DETAILED DESCRIPTION

Figure 1:
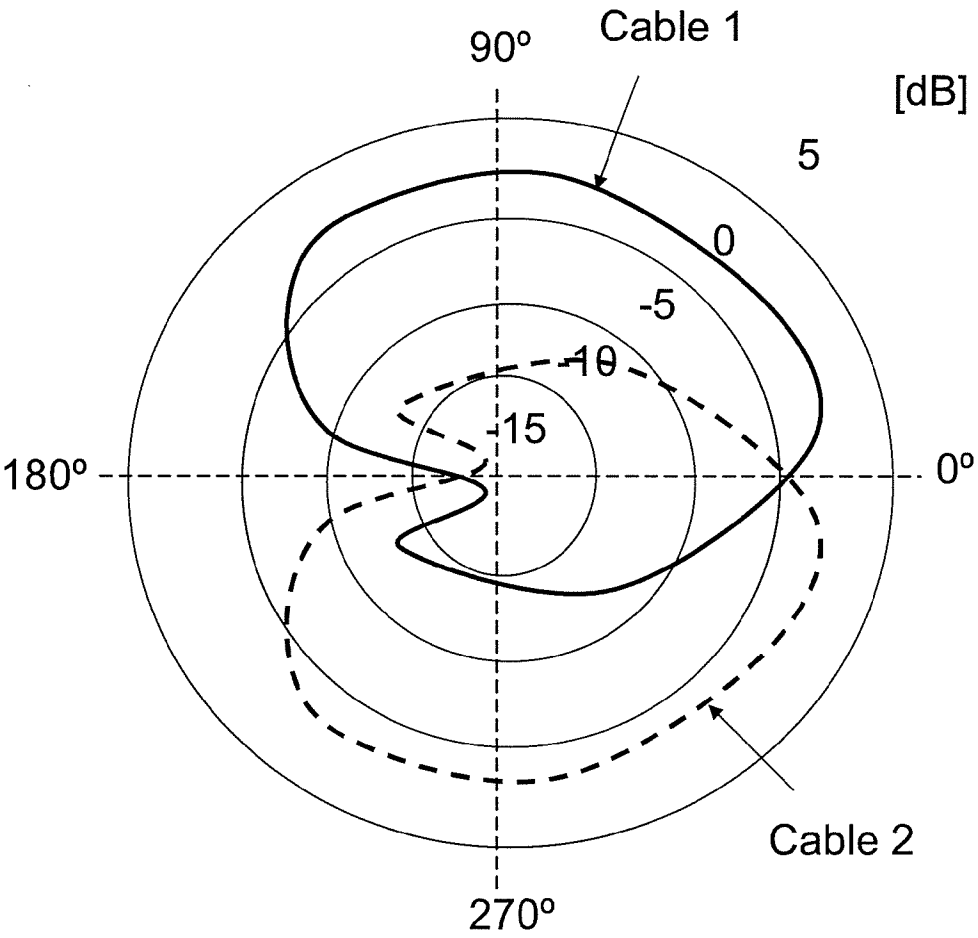
FIG. 1 shows typical azimuth antenna patterns for a prior art antenna solution including two leaky cables.

The invention will be described below with reference to the accompanying drawings, in which the structures for guiding an electromagnetic wave are shown as coaxial cables. It should however be pointed out that this is merely an example intended to enhance the reader's understanding of the invention and should not be seen as limiting the choice of structure, which can, for example, also comprise one or more of the following:

waveguides, strip line arrangements, micro strip arrangements.

In addition, the invention will be described by means of examples which comprise two or more structures or cables. Again, the number of cables shown is merely an example intended to enhance the reader's understanding of the invention, and should not be seen as limiting the number of cables which can be used within the scope of the present invention. In the drawings, like reference signs refer to like elements.

A concept of the embodiments described hereinafter is to provide an antenna arrangement comprising at least two elongated structures, e.g. coaxial cables, for guiding an electromagnetic wave, and wherein each of said structures comprising a plurality of radiation elements. The elongated structures exhibit a longitudinal direction of extension and are positioned alongside each other in their longitudinal direction of extension forming a bundle. Furthermore, the structures are arranged within the bundle such that the radial positions of said structures are alternated in the longitudinal direction of extension. Thus, by cyclically change position of the location of each structure in the cross-section of the bundle, the occurrence is equal for all structures at all positions along the extension of the bundle. In this way the average radiation pattern is equal for all structures.

Moreover, when the structures within the bundle are regularly interchanged such that all structures occupy each specific location in the cross-section of the bundle with the same frequency i.e. probability, the link gains of the different structures are evened out. Moreover, any radiation efficiency imbalance is also evened out. The antenna arrangement will also enable improved MIMO channel performance especially in line of sight conditions.

There are multiple ways of achieving equal probability of the structure locations in a cross-section of the bundle, along the extension of the bundle, whereof some are described in detail in the following.

In the following the above mentioned embodiments will be further explained with reference to FIGS. 2*a*-2*c*, 3*a*-3*c*, 4*a*-4*b*, 5 and 6.

Figure 2B:
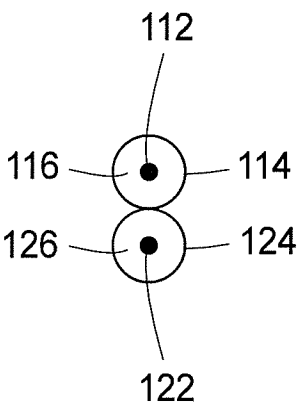
FIG. 2*a* depicts a first example of an embodiment of a twisted pair bundle of leaky feeders and FIG. 2*b* is a sectional view of the same example.
Figure 2A:
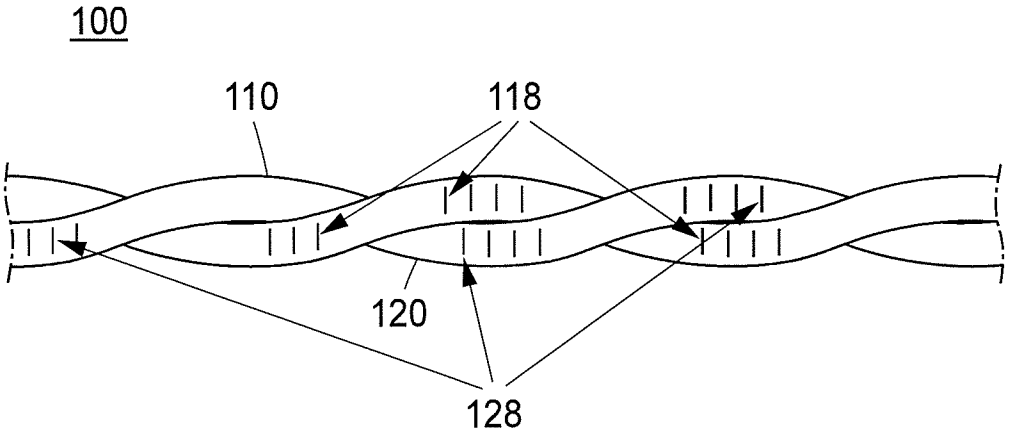

In FIG. 2*a* a first example of an embodiment 100 of the invention is shown and in FIG. 2*b* a sectional view of the same example is depicted. The embodiment 100 comprises a first 110 elongated structure and a second 120 elongated structure, e.g. coaxial cables, each of which comprises an inner conductor 112, 122 and an outer conductor 114, 124, which are separated from the respective inner conductor by a dielectric layer 116, 126. An alternative to a dielectric layer is a dielectric spacer, i.e. a spacer of a dielectric material. Both coaxial cables 110, 120 exhibit a longitudinal direction of extension and are positioned alongside each other in their longitudinal direction of extension forming a bundle. The first cable 110 comprises a plurality of radiation elements 118 and the second cable 120 also comprises a plurality of radiation elements 128. Not all of the radiation elements are shown in FIG. 2*a* nor have all of the shown radiation elements been provided with reference numbers.

The radiation elements of the embodiment 100 are elongated slots which are through-going perforations in the outer conductor 114, 124, and have a main direction of extension which makes the slots radiate. The main direction of extension which makes a slot radiate differs between different kinds of cables:

in a coaxial cable, as shown in the drawings, the main direction of extension should not coincide with the cable's main length of extension. In a waveguide, or a micro strip or strip line structure, the main direction of extension of a slot can coincide with that of the structure or cable and still radiate. Regarding the exact shape of the radiation elements, it should be pointed out that although they are shown as elongated slots in the drawings and referred to in this way in the description, the shape of the radiation elements can be chosen from a wide variety of different kinds of perforations in the outer conductor, although preferred embodiments include elongated rectangular or oval slots. It should however be pointed out that most shapes of perforations will give rise to a radiating effect. Also, with reference to other kinds of possible structures for guiding an electromagnetic wave, such as waveguides or strip line and micro strip structures, it can be pointed out that the perforations which form the radiation elements should be made in the conductor of such structures. However, all elongated structures forming the bundle should preferably comprise perforations of approximately the same shape and distribution.

Figure 2C:
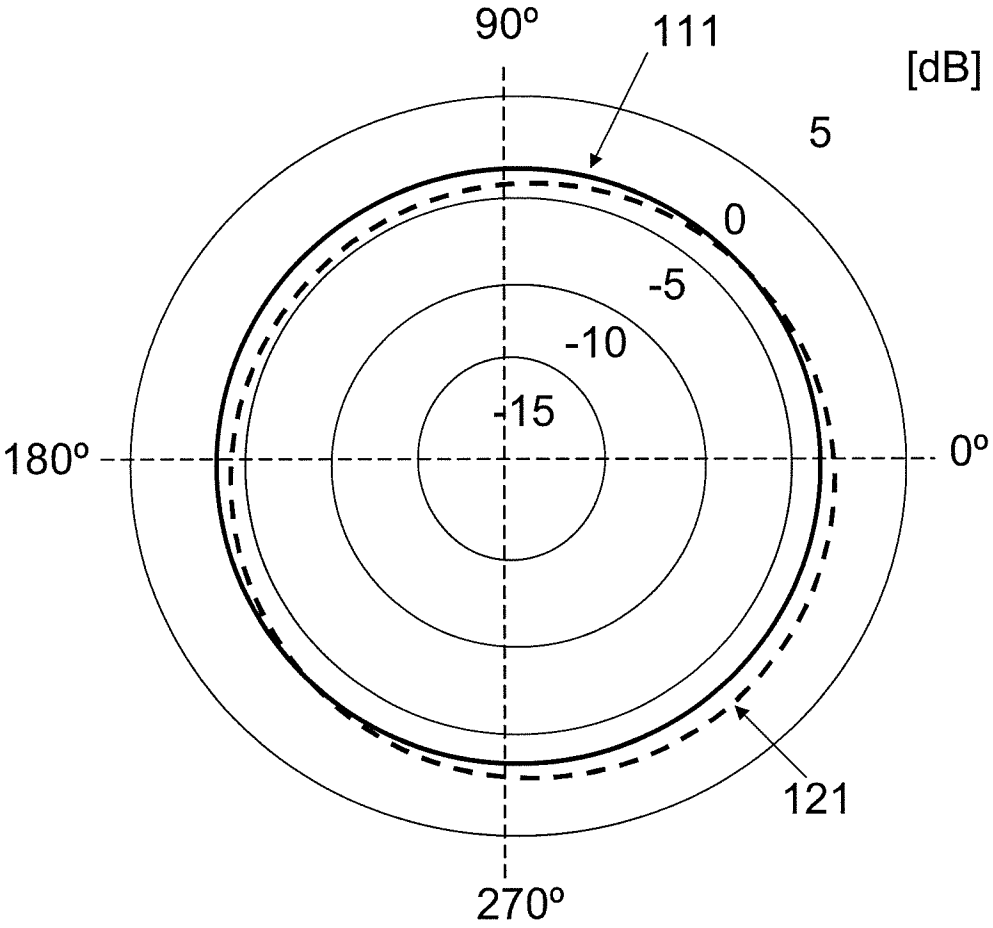
FIG. 2*c* shows azimuth antenna patterns for the first example of an embodiment.

Furthermore, as shown in FIG. 2*a* the cables 110, 120 are twisted i.e. they are arranged within the bundle such that the radial positions of the cables are alternated in the longitudinal direction of extension. Thus, by cyclically changing position of the location of each cable 110, 120 in the cross-section of the bundle, the occurrence is equal for both cables 110, 120 at all positions along the extension of the bundle. The described example of embodiment 100 of the invention will typically cause both cables to radiate with similar characteristics. Azimuth antenna patterns for the embodiment 100 are shown in FIG. 2*c*. The antenna pattern of the first cable 111 and the antenna pattern of the second cable 121 cover the same angular interval, which can be seen in the figure. Thus, the power is balanced for the different antenna branches of the cables, which is particularly advantageous in line-of-sight conditions.

In addition, the embodiment 100 may be used as an antenna for MIMO applications, Multiple Output Multiple Input. In MIMO applications, two different data streams $D_1$ and $D_2$ may be transmitted, one in each cable 110, 120, or both streams may be transmitted in both cables 110, 120, if the appropriate gain and/or phase weighting of the data streams is applied. The embodiment 100 is highly suitable for MIMO applications, since the two cables will have very similar radiation patterns, thereby reducing the likelihood of power imbalance in the MIMO channel which would otherwise result in reduced capacity.

Figure 3B:
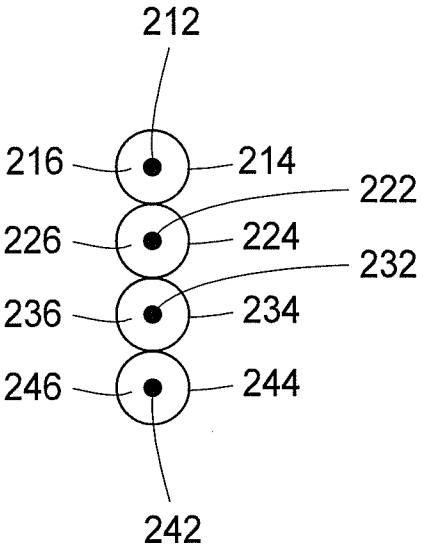
FIG. 3*a* depicts a second example of an embodiment of a flat bundle of four leaky feeders and FIG. 3*b* is a sectional view of the same example.
Figure 3A:
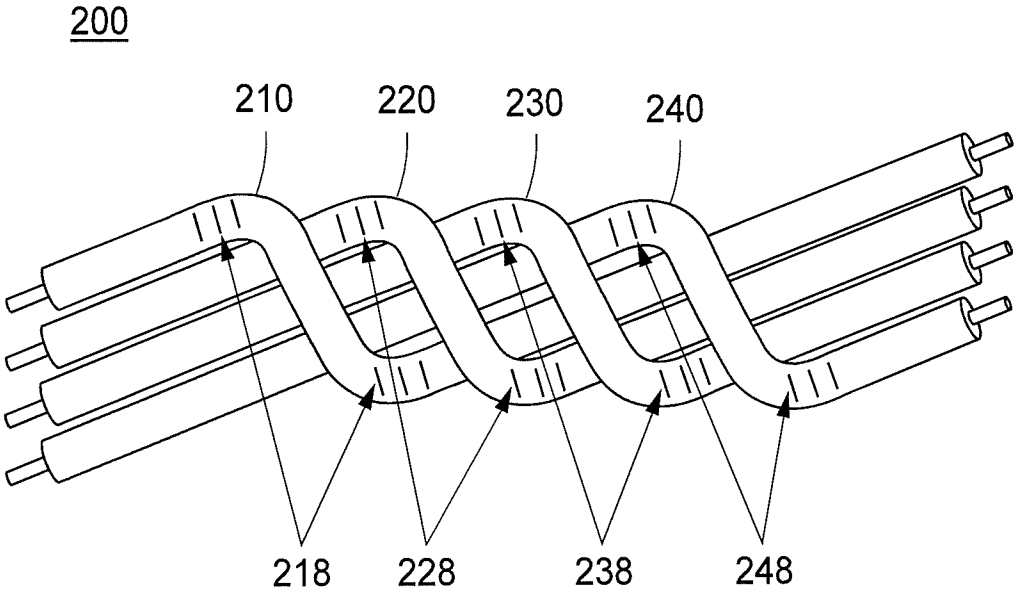

In FIG. 3*a* a second example of an embodiment 200 of the invention is shown and in FIG. 3*b* a sectional view of the same example is depicted. The embodiment 200 comprises a first 210 elongated structure, a second 220 elongated structure, a third elongated structure 230 and a fourth elongated structure 240 e.g. coaxial cables, each of which comprises an inner conductor 212, 222, 232, 242 and an outer conductor 214, 224, 234, 244 which are separated from the respective inner conductor by a dielectric layer 216, 226, 236, 246. An alternative to a dielectric layer is a dielectric spacer, i.e. a spacer of a dielectric material. All coaxial cables 210, 220, 230, 240 exhibit a longitudinal direction of extension and are positioned alongside each other in their longitudinal direction of extension forming a substantially flat bundle. Each cable 210, 220, 230, 240 comprises a plurality of radiation elements 218, 228, 238, 248, respectively. For reasons of clarity, not all of the radiation elements are shown in FIG. 3*a* nor have all of the shown radiation elements been provided with reference numbers.

The radiation elements of the embodiment 200 are also elongated slots which are through-going perforations in the outer conductor 214, 224, 234, 244, and have a main direction of extension which makes the slots radiate. Preferably, the shape and the distribution of the perforations are approximately equal for all cables.

Furthermore, as shown in FIG. 3*a* the cables 210, 220, 230, 240 are arranged within the bundle such that the radial positions of the cables 210, 220, 230, 240 are alternated in the longitudinal direction of extension. The alternation of radial positions of the cables 210, 220, 230, 240 may be formed by folding at least one cable residing at a first side of the bundle to a second side of the bundle. Thus, by cyclically changing position of the location of each cable 210, 220, 230, 240 in the cross-section of the bundle, the occurrence is equal for all cables 210, 220, 230, 240 at all positions along the extension of the bundle. Furthermore, the alternation of radial positions of the cables 210, 220, 230, 240 may be formed by different kinds of folding techniques such as plaiting, braiding, pleating or wounding.

Figure 3C:
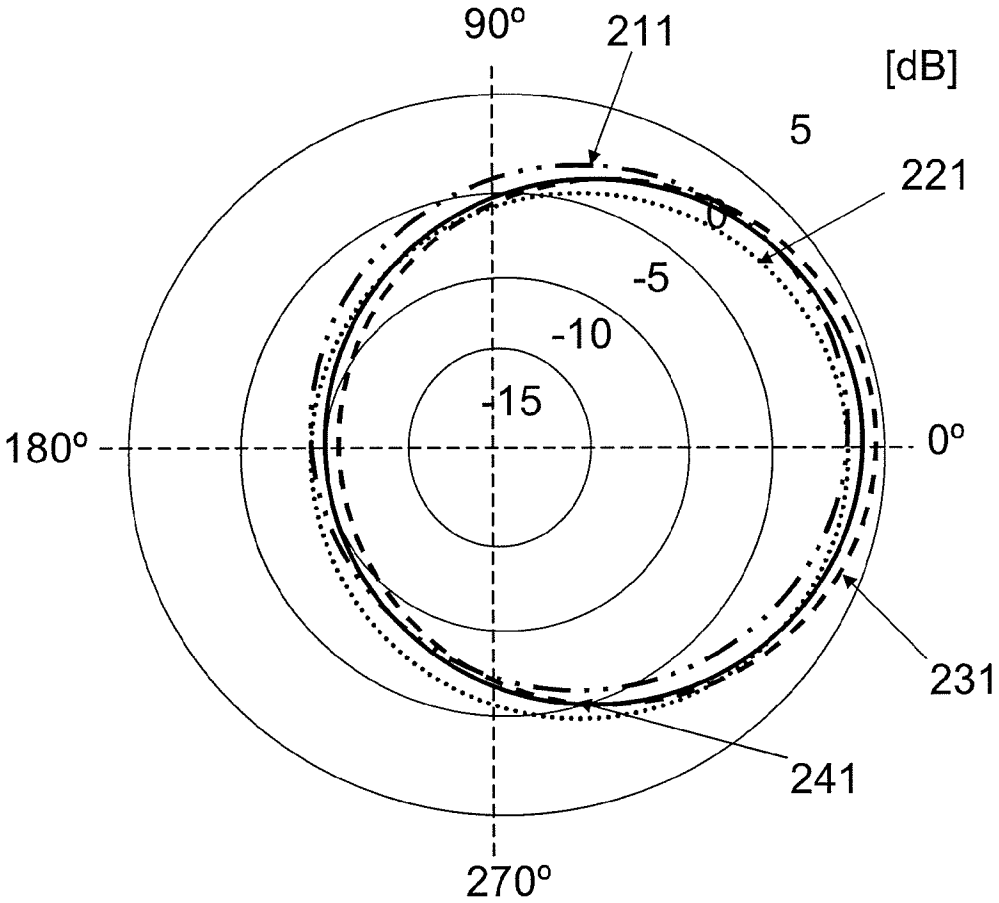
FIG. 3*c* shows azimuth antenna patterns for the second example of an embodiment.

The described example of embodiment 200 of the invention will typically cause all cables to radiate with similar characteristics. Azimuth antenna patterns for the embodiment 200 are shown in FIG. 3*c*. The antenna pattern of the first cable 211, the antenna pattern of the second cable 221, the antenna pattern of the third cable 231 and the antenna pattern of the fourth cable 241 cover the same angular interval, which can be seen in the figure. Thus, the power is balanced for the different antenna branches of the cables, which is particularly advantageous in line-of-sight conditions.

In addition, the embodiment 200 can also be used as an antenna for MIMO applications, Multiple Output Multiple Input. In MIMO applications, up to four different data streams $D_1$, $D_2$, $D_3$ and $D_4$ may be transmitted, one in each cable 210, 220, 230, 240, or up to four streams may be transmitted in all cables 210, 220, 230, 240, if the appropriate gain and/or phase weighting of the data streams is applied. The embodiment 200 is highly suitable for MIMO applications, since the four cables radiate mainly within the same angular interval reducing the likelihood of power imbalance in the MIMO channel. Thus, the capacity of the antenna arrangement is improved.

An advantage with the embodiment 200 of the present invention shown in FIGS. 3*a* and 3*b* is that it enables installation where limited thickness of the antenna arrangement is allowed, such as when installing on a flat surface such as a wall or ceiling. Another advantage of the embodiment 200 of the present invention is that it provides the possibility to arrange the antenna arrangement to radiate mainly in one direction i.e. by placing the radiation elements of each outer conductor 214, 224, 234, 244 on the same side of the bundle.

Figure 4B:
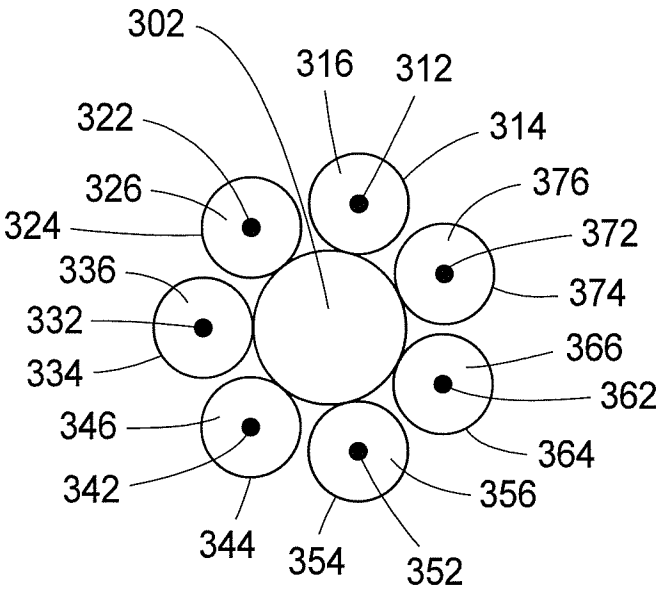
FIG. 4*a* depicts a third example of an embodiment of a hawser like bundle of multiple leaky feeders and FIG. 4*b* is a sectional view of the same example.
Figure 4A:
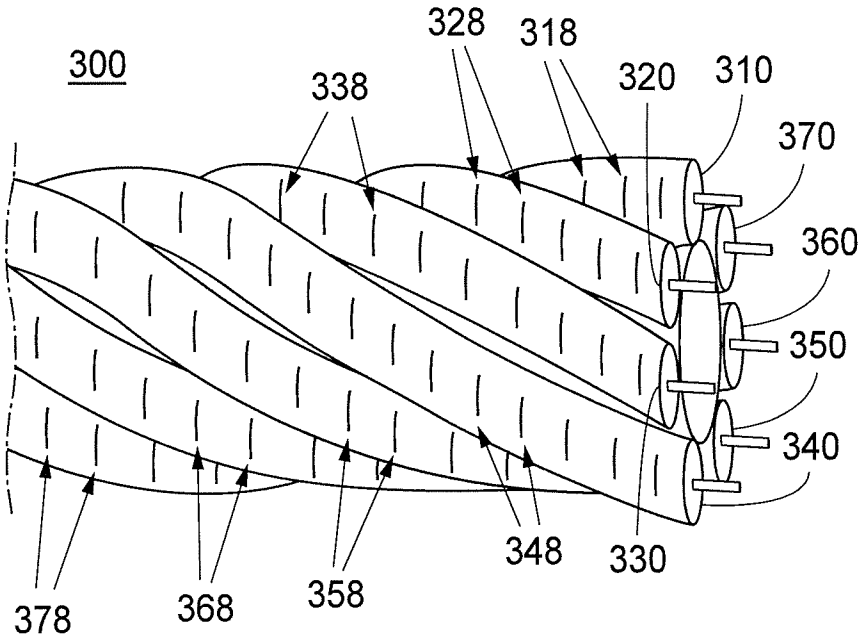

In FIG. 4*a* a third example of an embodiment 300 of the present invention is shown and in FIG. 4*b* a sectional view of the same example is depicted. The embodiment 300 comprises a plurality of elongated structure 310-370, e.g. coaxial cables, each of which comprises an inner conductor 312-372 and an outer conductor 314-374 which are separated from the respective inner conductor by a dielectric layer 316-376. An alternative to a dielectric layer is a dielectric spacer, i.e. a spacer of a dielectric material. All coaxial cables 310-370 exhibits a longitudinal direction of extension and are positioned alongside each other in their longitudinal direction of extension forming a substantially circular bundle. Each cable 310-370 comprises a plurality of radiation elements, respectively. For reasons of clarity, only some of the radiation elements 318-358 of some of the cables are shown in FIG. 4*a*. It should also be pointed out that not all of the shown radiation elements have been provided with reference numbers.

The radiation elements of the embodiment 300 are also in this embodiment elongated slots which are through-going perforations in the outer conductor 314-374, and have a main direction of extension which makes the slots radiate. Preferably, the shape and the distribution of the perforations are approximately equal for all cables.

Furthermore, as shown in FIG. 4*a* the cables 310-370 are arranged within the bundle such that the radial positions of the cables 310-370 are alternated in the longitudinal direction of extension. The alternation of radial positions of the cables 310-370 may be formed by twisting the cables around a core 302. Thus, by cyclically changing position of the location of each cable 310-370 in the cross-section of the bundle, the occurrence is equal for all cables 310-370 at all positions along the extension of the bundle. The core 302 may comprise a conducting material to avoid absorption loss if any slots radiate in a direction towards the core. However, in another embodiment the core 302 may comprise a non-conducting material. An advantage of the described example of the embodiment 300 of the invention is that when the core comprises a conducting material, absorption loss could be avoided when radiation elements 318-378 radiate inwards.

Also the embodiment 300 shown in FIGS. 4*a* and 4*b* can be used as an antenna for MIMO applications. In MIMO applications, up to seven different data streams $D_1$-$D_7$ may be transmitted, one in each cable 310-370, or up to seven streams may be transmitted in all cables 310-370, if the appropriate gain and/or phase weighting of the data streams is applied. The embodiment 300 is highly suitable for MIMO applications, since the seven cables radiate mainly within the same angular interval.

Figure 5:
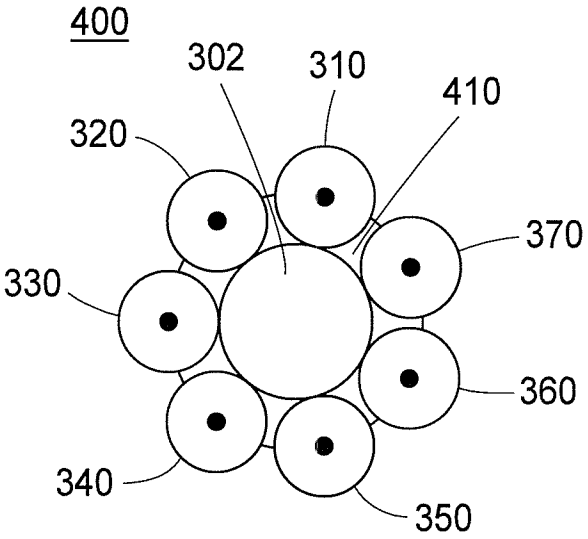
FIG. 5 shows a sectional view of a fourth example embodiment of the invention comprising a locking arrangement.

FIG. 5 shows a sectional view of a fourth embodiment 400 of an antenna arrangement which can be applied to any of the embodiments shown in FIGS. 2-4, but which is here shown applied to the embodiment 300 of FIG. 4. In order to ensure the proper distances and angles between the cables 310-370 in the antenna arrangement 300, the cables 310-370 are locked in their positions with respect to each other by a locking arrangement 410. That is, the locking arrangement locks the cables in a predetermined position relative to each other with respect to their longitudinal extensions and to a distance between the cables. The locking arrangement 410 can be designed in a number of ways, such as, for example interacting protrusions in one of the cables and interacting apertures in the other cable, locking bands or hook and loop type fasteners. In some embodiments these locking arrangements assume that each cable is surrounded by a protective non-conducting sheathing, such as rubber sheathing.

Figure 6:
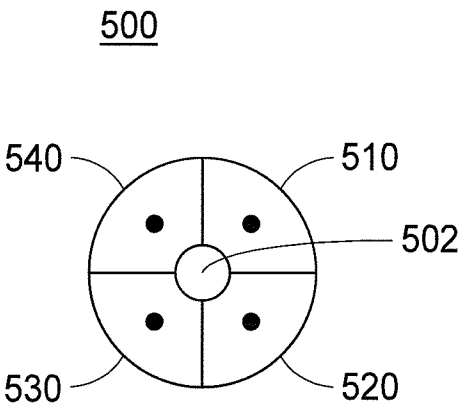
FIG. 6 shows a sectional view of fifth example of an embodiment of the invention.

The locking arrangement 410 in the arrangement of FIG. 5 is however different from the ones listed above: instead, the cables 310-370 shown in FIG. 5 are partly encased in a piece of dielectric material 410, e.g. plastic, which locks them in place, i.e. there is a sheathing of a non-conducting material at least partly surrounding each of the cables. In another embodiment the locking arrangement may comprise a filling of a non-conducting material at least partly surrounding each of the cables FIG. 6 shows a sectional view of a fifth example of an embodiment 500. In this embodiment the alternation of radial positions of the cables 510-540 may be formed by twisting the cables around a core 502 in a way described in conjunction with embodiment 300 shown in FIG. 4. However, in the embodiment 500 the cross-section of the cables may be formed to be a part of the locking arrangement, insuring the proper distances and angles between the cables as shown in FIG. 6.

Also, it should be pointed out that although the arrangement of the invention has been described above primarily with reference to transmission, the inventive arrangement works equally well for reception, and will thus be able to be used for receive diversity or MIMO reception.

The present invention is not limited to the above-described preferred embodiments. Various alternatives, modifications and equivalents may be used. Therefore, the above embodiments should not be taken as limiting the scope of the invention, which is defined by the appending claims.

The invention claimed is:

1. An antenna arrangement comprising:

a plurality of elongated structures for guiding an electromagnetic wave, each of said elongated structures including a plurality of radiation elements, each of said elongated structures exhibiting a longitudinal direction of extension; and a locking arrangement for locking the plurality of elongated structures in a predetermined position relative to each other with respect to their longitudinal extensions and relative to a distance between the structures, wherein said elongated structures are positioned alongside each other in their longitudinal direction of extension forming a bundle, and wherein said elongated structures are arranged within the bundle such that the radial positions of said elongated structures are alternated in the longitudinal direction of extension.

2. The antenna arrangement according to claim 1, wherein said elongated structures form a flat bundle.

3. The antenna arrangement according to claim 2, wherein said elongated structures are plaited, braided, pleated or wounded.

4. The antenna arrangement according to claim 2, wherein at least one of said elongated structures is folded at a first side of the bundle to a second side of the bundle.

5. The antenna arrangement according to claim 1, wherein said elongated structures form a circular bundle.

6. The antenna arrangement according to claim 4, wherein said elongated structures are twisted.

7. The antenna arrangement according to claim 4, wherein the bundle includes a core and said elongated structures are twisted around said core.

8. The antenna arrangement according to claim 1, wherein said elongated structures are a coaxial cable.

9. The antenna arrangement according to claim 1, wherein the locking arrangement includes a sheathing of a non-conducting material at least partly surrounding each of said structures.

10. The antenna arrangement according to claim 1, wherein the locking arrangement includes a filling of a non-conducting material at least partly surrounding each of said structures.

11. The antenna arrangement according to claim 1, wherein the locking arrangement includes one or more of the following: an interacting protrusions in one of the structures and interacting apertures in the other structure, locking bands and hook and loop type fasteners.

12. The antenna arrangement according to claim 1, wherein the locking arrangement includes interacting protrusions in a first elongated structure from the plurality of elongated structures and corresponding interacting apertures in a second elongated structure of the plurality of elongated structures.

13. The antenna arrangement according to claim 1, wherein each of the radiation elements extend in a direction perpendicular to the longitudinal direction.

* * * * *